United States Patent [19]

Lanham

[11] 4,195,427

[45] Apr. 1, 1980

[54] CHAIN TRENCHER

[75] Inventor: Roy S. Lanham, Abilene, Tex.

[73] Assignee: Lanham Manufacturing Co., Inc., Abilene, Tex.

[21] Appl. No.: 926,553

[22] Filed: Jul. 20, 1978

[51] Int. Cl.[2] ..... E02F 5/06

[52] U.S. Cl. ..... 37/90

[58] Field of Search ..... 37/97, 82–87, 37/89, 90, 69, 191 R, 192 R, DIG. 2

[56] References Cited

U.S. PATENT DOCUMENTS

| | | | |
|---|---|---|---|
| 1,717,476 | 6/1929 | Topping | 37/90 |
| 2,723,473 | 11/1955 | Ludowici | 37/90 X |
| 2,737,733 | 3/1956 | Everett | 37/90 |
| 2,790,255 | 4/1957 | Riley et al. | 37/90 |
| 3,022,585 | 2/1962 | Bradley | 37/86 |
| 3,050,881 | 8/1962 | Brown | 37/86 |
| 3,108,387 | 10/1963 | Penote | 37/90 |
| 3,266,179 | 8/1966 | Golden | 37/86 |
| 3,307,276 | 2/1967 | Russell | 37/90 |
| 3,785,071 | 1/1974 | Schaeff | 37/90 |
| 4,043,135 | 8/1977 | Hoes et al. | 37/86 X |

FOREIGN PATENT DOCUMENTS

| | | | |
|---|---|---|---|
| 693250 | 8/1964 | Canada | 37/90 |
| 1277158 | 9/1968 | Fed. Rep. of Germany | 37/90 |
| 1367648 | 6/1964 | France | 37/90 |

*Primary Examiner*—E. H. Eickholt
*Attorney, Agent, or Firm*—Wendell Coffee

[57] ABSTRACT

An excavator digs trenches by partial buckets on a vertical chain which is adjustable as to contact with the ground by two hydraulic cylinders. The excavator is built upon a frame having wheels, with the back wheels being driven by a hydraulic motor so that the vehicle creeps forward at a very slow speed. Excavated dirt is contained by the partial buckets in conjunction with a plate behind the buckets. The dirt is then transferred by means of troughs on the buckets to a belt which conveys it away from the trench.

15 Claims, 6 Drawing Figures

Fig. 3
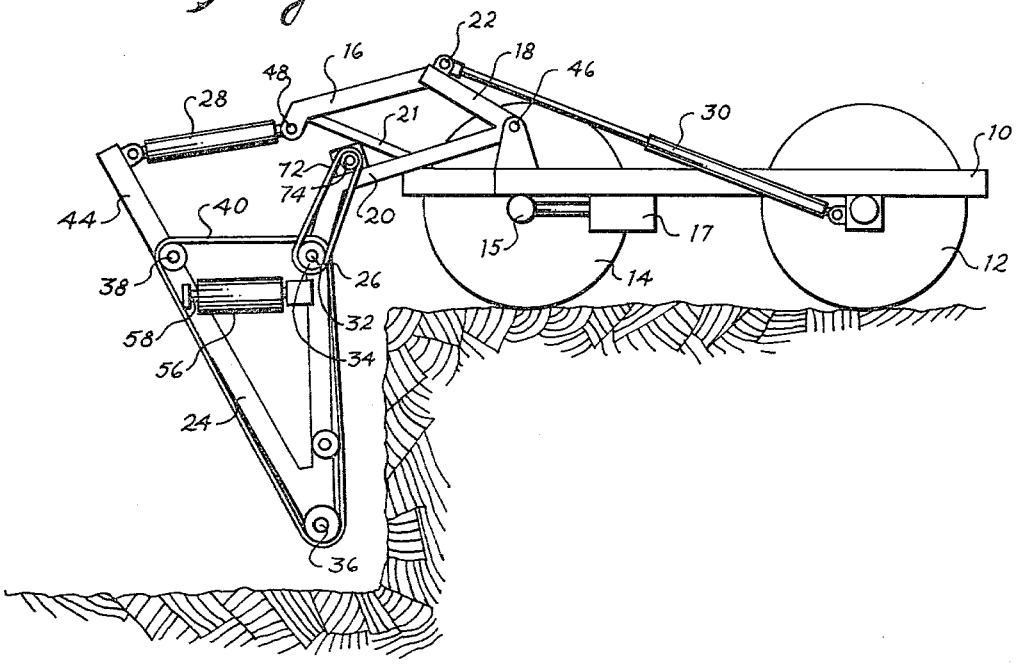
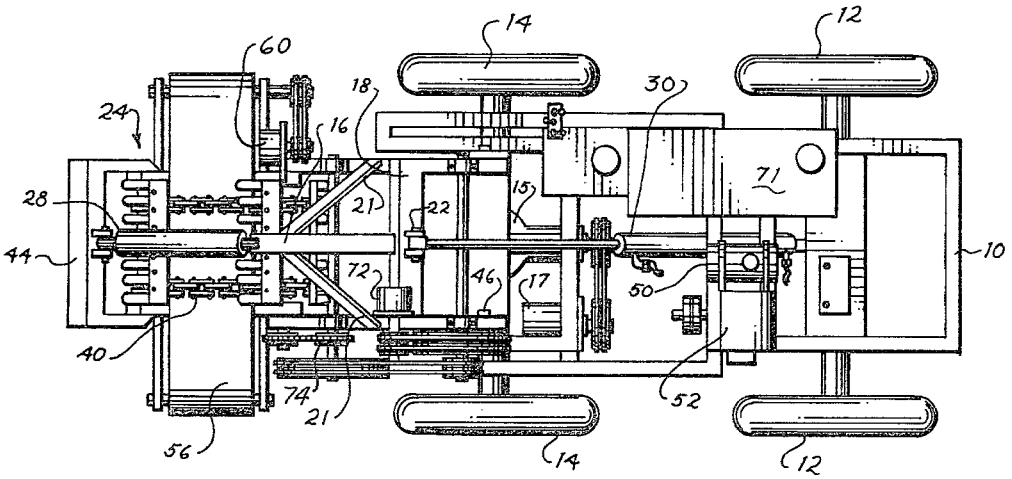
Fig. 4

Fig. 5
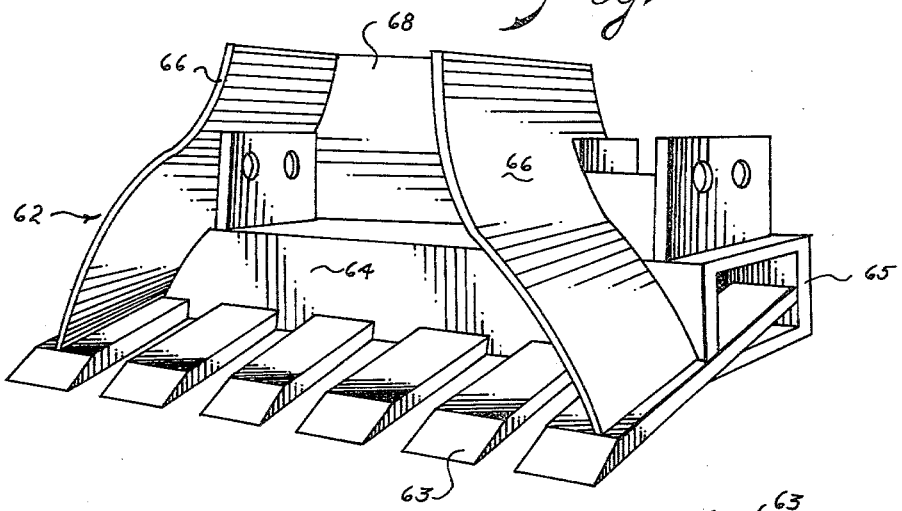
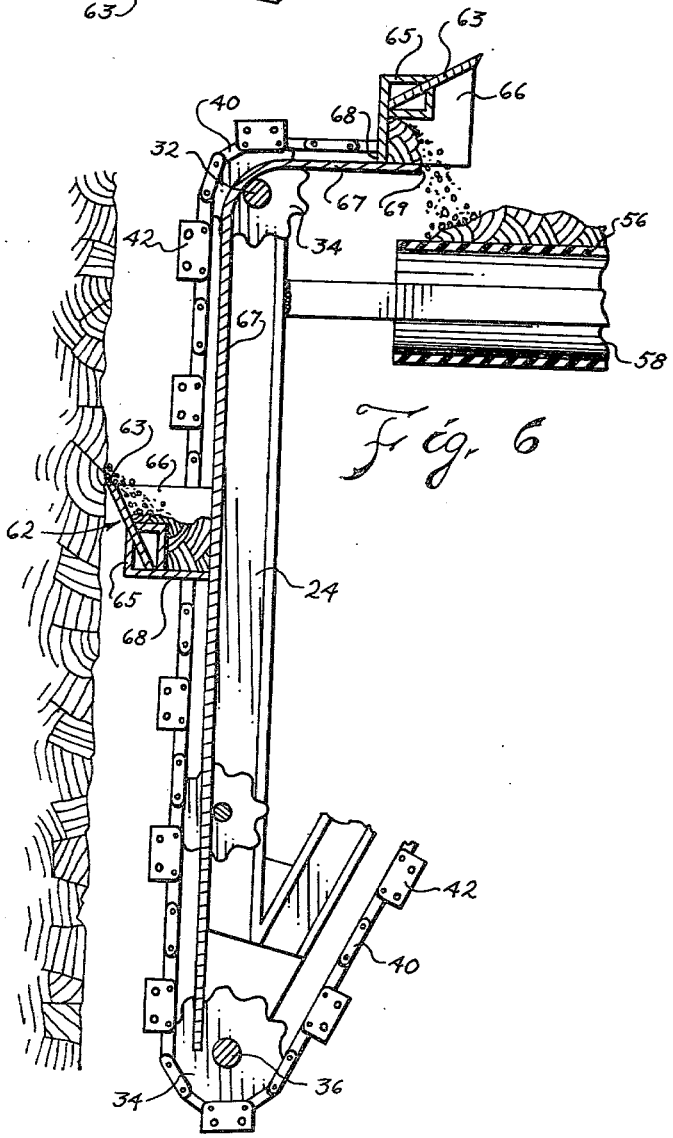
Fig. 6

CHAIN TRENCHER

BACKGROUND OF THE INVENTION (1) Field of the Invention

This invention relates to excavating equipment and more particularly to chain driven trench diggers.

(2) Description of the Prior Art

Earth working machines for excavating by means of chain driven tools have long been known in the art. While these machines were obviously much more efficient than hand digging, there were drawbacks inherent. Inventors have struggled to perfect machines which creep forward as they dig.

As the digging tool of an excavator engages the dirt, a force is exerted opposite the direction that the digging tool is moving. Clearly, this causes a waste of energy and time as, in the prior art, the digging tool is working against the motion of the machine.

The prior art discloses machines with single hydraulic cylinders for adjusting the depth of cut by adjusting the angle of intersection between the digging tool and the dirt.

Another problem with trenching machines is disposing of the excavated dirt. Once a complete bucket is filled with dirt, it must be overturned to empty it. If a complete bucket is rigidly attached to a chain, it is only completely overturned when it turns down on a return run. When the rigidly attached bucket is on a run parallel to the ground, some of its contents may spill. This spillage is uncontrollable. The bucket must be emptied before the return run or the dirt will be emptied back into the trench. Buckets which are free to pivot between the driving chains generally aren't as efficient as rigidly attached buckets at engaging the dirt and digging. Also, once the bucket is full it will not easily turn over to dump its contents out within additional mechanization.

Known prior art includes:

Everett U.S. Pat. No. 2,737,733

Riley et al U.S. Pat. No. 2,790,255

Bradley U.S. Pat. No. 3,022,585

Golden U.S. Pat. No. 3,266,179

Hoes et al U.S. Pat. No. 4,043,135

Hoes et al. discloses the use of a pivoted trenching connection assembly with which the angle of the chain trencher may be changed.

Bradley discloses a bucket chain and dirt conveyor, however, there is no adjusting means to control the angle of the chain trencher.

Riley et al. and Everett disclose bucket chains with buckets between them.

Golden discloses a chain saw type digger with pivot connections and hydraulic cylinders.

SUMMARY OF THE INVENTION (1) New and Different Function

I have solved the problem of efficiently and smoothly changing the angle of contact with the ground by the chain driven teeth on a trencher. This is accomplished by using two hydraulic cylinders; one to raise and lower the trenching assembly and the other to adjust the angle of contact between the chain's teeth and the ground. By use of a separate cylinder to adjust the angle of contact of the chain-driven teeth with the ground, I can achieve a cut that is greater than 90° from horizontal. As the angle of contact increases above 90°, a pulling motion is imported to the vehicle in the direction of cut. This results in a slow movement forward of the vehicle.

I have solved the problem of efficient disposition of excavated dirt by use of partial buckets in conjunction with a backing plate. As the partial bucket begins the digging run it comes into contact with a backing plate which closes the bucket making it an effective dirt container. The dirt is carried against the backing plate until the plate ends in the removal run. The termination of the backing plate is directly above a moving belt. As the backing plate no longer supports the dirt, it falls on the belt which conveys it to one side of the trench being dug. Having disposed of the dirt, the partial bucket returns to the digging run to complete the cycle again.

Thus, it may be seen that the total function is far greater than the sum of the individual functions of the hydraulic cylinders, chain, teeth, etc.

(2) Objects of this Invention

An object of this invention is to dig trenches.

Another object is to dispose of excavated dirt in an efficient manner.

Further objects are to achieve the above with a device that is sturdy, compact, durable, lightweight, simple, safe, efficient, versatile, ecologically compatible, energy conserving, and reliable, yet inexpensive and easy to manufacture, adjust, operate and maintain.

The specific nature of the invention, as well as other objects, uses, and advantages thereof, will clearly appear from the following description and from the accompanying drawing, the different views of which are not scale drawings.

BRIEF DESCRIPTION OF THE DRAWINGS

FIG. 3 is a schematic representation of the mechanism showing the principal elements thereof.

FIG. 4 is a top plan view of the excavator of FIG. 1.

FIG. 5 is a perspective view of a second embodiment of one bucket.

FIG. 6 is a partial sectional view of the chain frame with the second embodiment of the buckets thereon.

DESCRIPTION OF THE PREFERRED EMBODIMENTS

Figure 1:
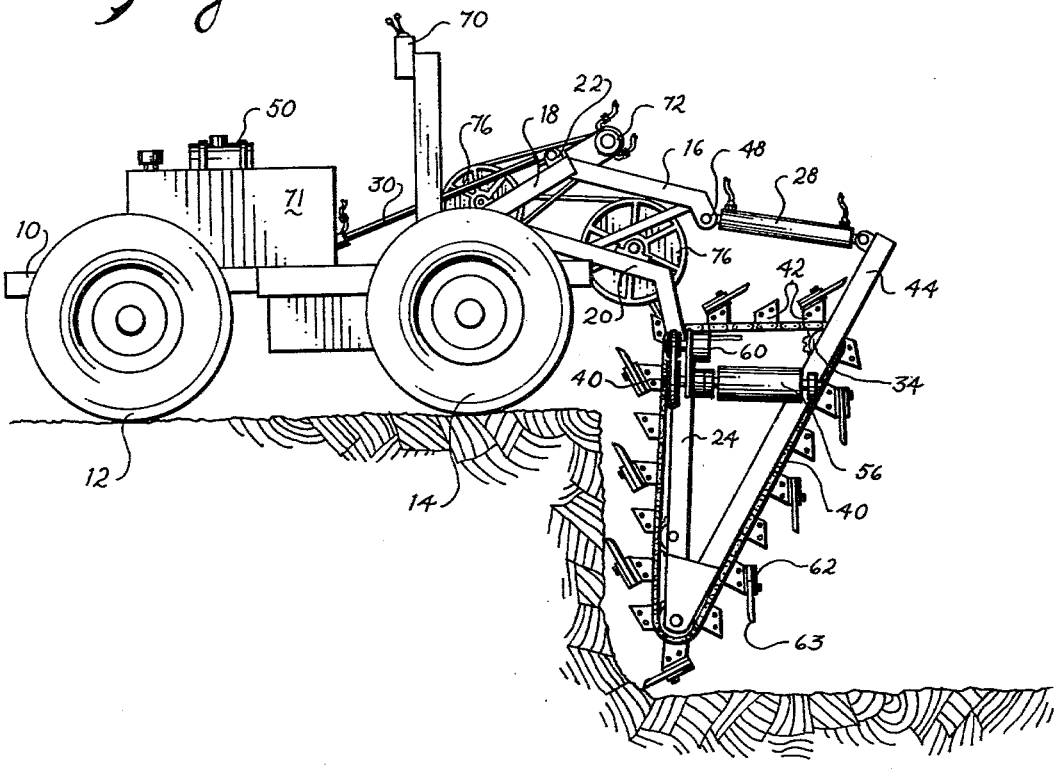
FIG. 1 is a side elevational view of a first embodiment of an excavator according to this invention, with the mechanism in digging position.

Referring to the drawings, my invention includes vehicle frame 10 on which are mounted ground engaging wheels 12 and 14. These wheels are located on the frame 10 in such a manner as to support the vehicle frame and facilitate movement of the vehicle. Internal combustion engine 50 and hydraulic pump 52 located on the vehicle frame are the source of power for the various elements of the excavator.

Differential 15 rotates the rear wheels 14. Power is transferred from the hydraulic pump 52 to the differential 15 by V-belts from hydraulic motor 17. When the motor 17 is activated, the vehicle creeps forward at a slow rate of speed. The vehicle is dirigible due to a power steering apparatus, not shown, which controls the front wheels 12 and is well known in the art.

A rigid elevating member including support legs 20, elevating collar 18, adjusting arm 16 and brace 21, is attached to the vehicle frame 10 at vehicle pivot 46. The pivot is at the junction of the support legs 20 and the elevating collar 18 on the elevating member and on bracket 47 on the frame 10. The adjusting arm 16 extends from the middle of the elevating collar 18 at elevating pivot 22 to adjusting power means 28. The support legs 20 extend from the elevating collar 18 at the pivot 46 to chain frame pivot 26. Braces 21 extend from the support legs 20 to the adjusting arm 16 to support the adjusting arm.

Elevating power means 30 extends from the vehicle frame 10 to elevating pivot 22. Both elevating power means 30 and adjusting power means 28 are in the form of hydraulic cylinders. When the elevating power means 30 is extended, chain frame 24 is lowered into digging position as shown in FIG. 1. When the elevating power means 30 is withdrawn, the chain frame 24 is drawn up into the travel position, shown in FIG. 2. The elevating power means 30 also allows the chain frame 24 to be placed in any number of positions between the travel position and the fully extended digging positions so that trench depth is variable.

The adjusting power means 28 extends from adjusting pivot 48 on the elevating member to chain frame 24. Adjusting pivot 48 is attached to chain yoke 44 which is attached to the chain frame 24 at the rear thereof, as shown. The adjusting power means may be extended or withdrawn, varying the angle at which digging teeth 63 intersect the dirt. The chain frame may be adjusted into a position where bottom shaft 36 is forward of power shaft 32. In this position, the force of the teeth while digging, instead of opposing the movement of the vehicle, actually helps pull it forward. This is clearly an advantage over similar excavating tools which, while digging, pull opposite the movement of the vehicle causing an additional expenditure of energy.

The digging assembly of this invention includes the triangular chain frame 24, the power shaft 32, sprockets 34, bottom shaft 36 and back shaft 38. Each shaft is journalled to the chain frame 24 with the power shaft 32 located adjacent to the support legs 20, the bottom shaft 36 being below the power shaft and the back shaft 38 being behind the power shaft the other angle of the triangular chain frame. The sprockets 34 are mounted on the shafts near the frame 24, thus forming two sets of sprockets which work together. Chain 40 is trained around each set of sprockets thereby forming: a digging run from the bottom shaft to the power shaft, a removal run from the power shaft to the back shaft and a down run from the back shaft to the bottom shaft. Plates 42 at which tools may be attached are equally spaced on the chains 40 such that digging tools may be attached between the chains. Tools may be attached to each of these plates or alternately spaced as the excavation demands.

Figure 2:
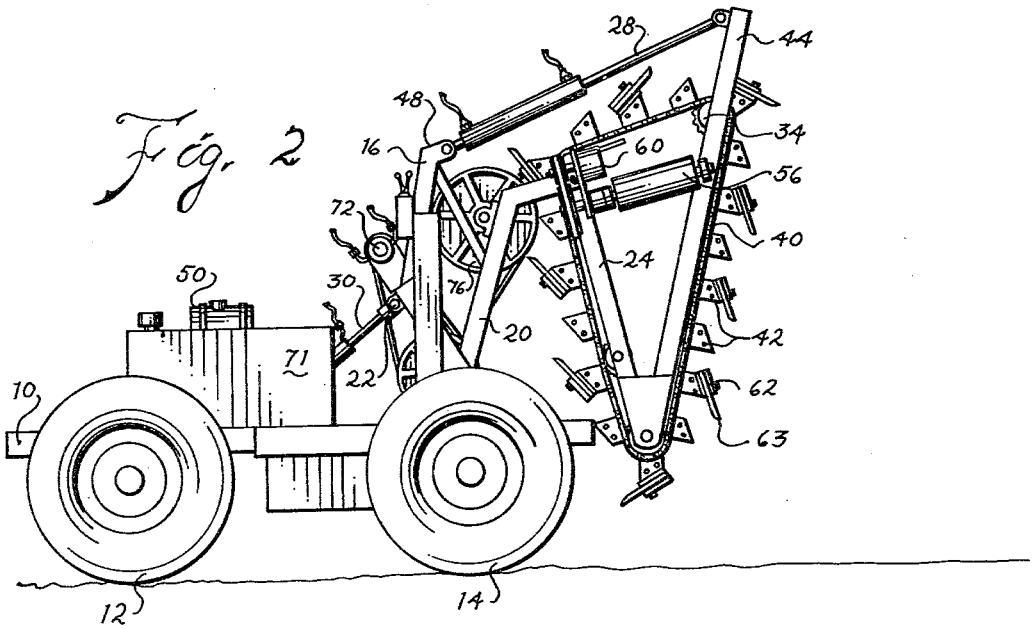
FIG. 2 is a side elevational view of a first embodiment with the mechanism in a travel position.

Partial buckets 62 are used in conjunction with the chains 40. One embodiment of the digging tool is shown in FIG. 5. The partial bucket 62 includes digging teeth 63, a front-bottom member 64 and trought plates 66. It may be seen that the front-bottom member 64 includes rectangular tubing (or two angle arms attached together) 65 and a bottom plate 68. However, those skilled in the art will understand that this front back plate could assume many different forms. In fact, it will be noted that the embodiment of FIG. 1 does not illustrate the use of rectangular tubing 65 but shows the plates 42 to be of trapezoid shape and a single plate attached across the trapezoid plate which holds the digging teeth 63. Therefore it may be seen that FIGS. 1 and 2 show a slightly different form of the partial bucket 62. The digging teeth 63 are oriented away from the chain 40 while the front-bottom member 64 extends from the teeth to behind the chain. Trough plates 66 form the sides of the partial bucket 62 and extend behind the chain as well.

Backing plate 67 (FIG. 6) is attached to the chain frame 24 and runs from the bottom shaft 36 along the digging run, terminating above dirt removal belt 56, a short way into the removal run. As the partial buckets 62 move along the digging run, the front-bottom member 64 and both trough plates 66 are in contact with backing plate 67 forming a dirt container. A short way into the removal run the backing plate 67 terminates at 69 and the rough plates 66 and front-bottom member 64 form a trough through which the excavated dirt is funnelled onto removal belt 56.

The removal belt 56 is trained around rollers 58 which are rotated by belt drive means 60, in the form of a hydraulic motor. The rollers 58 are journalled to the chain frame 24. The rotation of belt drive means 60 is reversible so that dirt may be deposited on either side of the newly excavated trench.

Internal combustion engine 50 and hydraulic pump 52, forming a source of power, are connected by hoses (not shown for clarity) to the hydraulic motors and cylinders. Those having ordinary skill in the art will understand the source of power is connected with valves 70 and hydraulic reservoir 72 so that power can be transmitted to different portions of the vehicle such as power steering for the dirigible front wheels 12 and to the hyraulic motor 17 furnishing power to the rear wheels through the differential. Also, power is furnished to the hydraulic cylinders 28 and 30 and to the hydraulic motor 60 forming a portion of the belt drive means.

Further, power is furnished to hydraulic motor 72 mounted upon the rigid elevating member. The hydraulic motor 72 forms the means for supplying power to the power shaft 32. The power is delivered through a series of V-belt drives to the sprocket 74 which is on a jack shaft also located upon the rigid elevating member. By chain, the sprocket 74 drives a similar sprocket located upon the power shaft 32. Inasmuch as the power shaft 32 and the chain frame pivot 26 are co-axial, it may be seen that this drive at all times will be operative.

Considering the drive and the characteristics of hydraulic motors, I find it highly desirable to place weights 76 upon the V-belt sheaves which forms a portion of the drive from the hydraulic motor 72 to the power shaft 32.

The embodiments shown and described above are only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific examples above do not point out what an infringement of this patent would be, but are to enable the reader to make and use the invention.

As an aid to correlating the terms of the claims to the exemplary drawing, the following catalog of elements is provided:

| | | | |
|---|---|---|---|
| 10 | vehicle frame | 46 | vehicle pivot |
| 12 | front wheels | 47 | bracket |

-continued

| | | | |
|---|---|---|---|
| 14 | rear wheels | 48 | adjusting pivot |
| 15 | differential | 50 | internal combustion engine |
| 16 | adjusting arm | 52 | hydraulic pump |
| 17 | hydraulic motor | 56 | dirt removal belt |
| 18 | elevating collar | 58 | rollers |
| 20 | support legs | 60 | belt drive means |
| 21 | brace | 62 | partial bucket |
| 22 | elevating pivot | 63 | digging teeth |
| 24 | chain frame | 64 | front-bottom member |
| 26 | chain frame pivot | 65 | retangular tubing |
| 28 | adjusting power means | 66 | trough plates |
| 30 | elevating power means | 67 | backing plate |
| 32 | power shaft | 68 | bottom plate |
| 34 | sprocket | 69 | terminal |
| 36 | bottom shaft | 70 | valves |
| 38 | back shaft | 71 | hydraulic reservoir |
| 40 | chain | 72 | hydraulic motor |
| 42 | plates | 74 | sprocket |
| 44 | chain yoke | 76 | weight |

I claim as my invention:

1. An excavating machine comprising:

a vehicle frame, ground engaging wheels located on said frame which support the frame, and facilitate movement of the vehicle frame, a rigid elevating member having four pivot points thereon, a vehicle pivot, an elevating pivot, a chain frame pivot, and an adjusting pivot, said elevating member pivoted to the vehicle frame at the vehicle pivot, a triangular chain frame pivoted to the chain frame pivot, an adjusting power means for adjusting the chain frame extending from the adjusting pivot to the chain frame, elevating power means extending from the vehicle frame to the elevating pivot for elevating the the chain frame, a power shaft journalled at one corner of the triangular chain frame, a bottom shaft below the power shaft journalled at another corner of the triangular chain frame, and a back shaft journalled behind the power shaft and at the third corner of the triangular frame, said elevating member pivoted to the chain frame at the corner having the power shaft, said adjusting power means being pivoted to the chain frame near the corner having the back shaft journalled thereto, and chain means having digging teeth attached thereto trained around said shafts whereby the chain means has a digging run from the bottom shaft to the power shaft, a removal run from the power shaft to the back shaft, and a down run from the back shaft to the bottom shaft.

2. The invention as defined in claim 1 further comprising;

a pair of belt rollers journalled to said frame, a dirt removal belt trained over the rollers, belt drive means for rotating said rollers in either direction so that the dirt may be dumped to either side, each of said shafts having two sprockets thereon, said chain means including two chains trained around said shafts, a series of partial buckets attached to said chains, each bucket having digging teeth on the bucket spaced away from the chains, a front-bottom member extending from said digging teeth to behind the chains, and trough plates extending from the front-bottom member to behind the chains, a backing plate attached to the chain frame behind the chains, said trough plates moving adjacent to and in close proximity to the backing plate thereby forming a dirt container defined by the backing plate on the chain frame and the front-bottom member and trough plates carried by the chains, said backing plate extending along the digging run and said backing plate extending along a portion of said removal run, said backing plate terminating on said removal run above said removal belt, whereby dirt is retained by the partial buckets to the termination of the backing plate and dumped at that termination onto the removal belt.

3. The invention as defined in claim 1 with the addition of a chain yoke attached to the chain frame adjacent to the back shaft, said adjusting power means pivoted to said chain yoke.

4. The invention as defined in claim 1 further comprising:

an adjusting arm extending between the elevating pivot and the adjusting pivot, an elevating collar extending between the vehicle pivot and the elevating pivot, support legs extending between the vehicle pivot and the chain pivot, and a brace extending between the support legs and the adjusting arm.

5. The invention as defined in claim 1 further comprising:

rollers journalled to said chain frame, a dirt removal belt trained around the rollers, belt drive means attached to said rollers for rotating said belt in either direction, said dirt removal belt located below said removal run of the chain means.

6. The invention as defined in claim 1 wherein said elevating power means and said adjusting power means are hydraulic cylinders.

7. The invention as defined in claim 1 further comprising:

a source of power on the vehicle frame for furnishing power to said power shaft, some of said ground engaging wheels, said elevating power means, and said adjusting power means.

8. The invention as defined in claim 7 wherein said source of power includes an internal combustion engine attached to a hydraulic pump.

9. The invention as defined in claim 8 wherein said elevating power means and said adjusting power means are hydraulic cylinders.

10. The invention as defined in claim 9 further comprising:
rollers journalled to said chain frame,
a dirt removal belt trained around the rollers,
belt drive means attached to said rollers for rotating said belt in either direction,
said dirt removing belt located below said removal run of the chain means.

11. The invention as defined in claim 10 with the addition of
a chain yoke attached to the chain frame adjacent to the back shaft,
said adjusting power means pivoted to said chain yoke,
an adjusting arm extending between the elevating pivot and the adjusting pivot,
an elevating collar extending between the vehicle pivot and the elevating pivot,
support legs extending between the vehicle pivot and the chain pivot, and
a brace extending between the support legs and the adjusting arm.

12. The invention as defined in claim 11 further comprising:
each of said shafts having two sprockets thereon,
two chains trained around said shafts,
a series of partial buckets attached to said chains, each bucket having
digging teeth on the bucket spaced away from the chain,
a front-bottom member extending from said digging teeth to behind the chain, and
trough plates extending from the front-bottom member to behind the chain,
a backing plate attached to the chain frame behind the chains,
said trough plates moving adjacent to and in close proximity to the backing plate thereby forming a dirt container defined by the backing plate on the chain frame and the front-bottom member and trough plates carried by the chain,
said backing plate extending along the digging run and
said backing plate extending along a portion of said removal run,
said backing plate terminating on said removal run above said removal belt,
whereby dirt is retained by the partial buckets to the termination of the backing plate and dumped at that termination onto the removal belt.

13. An excavating machine comprising:
a triangular chain frame,
a power shaft journalled at one corner of the triangular frame,
a bottom shaft journalled at another corner of the triangular frame, and
a back shaft journalled at yet another corner of the triangular frame,
each of said shafts having two sprockets thereon,
two chains trained around said shafts whereby said chains have
a digging run from the bottom shaft to the power shaft
a removal run from the power shaft to the back shaft, and
a down run from the back shaft to the bottom shaft
a series of partial buckets attached to said chains, each bucket having
digging teeth on the bucket spaced away from the chain,
a front-bottom member extending from said digging teeth to behind the chain,
trough plates extending from the front-bottom member behind the chain,
a backing plate attached to the chain frame behind the chains,
said trough plates moving adjacent to and in close proximity to the backing plate thereby forming a dirt container defined by the backing plate on the chain frame and the front-bottom member and trough plates carried by the chain,
said backing plate extending along the digging run and
said backing plate extending along a portion of said removal run,
said backing plate terminating on said removal run above a dirt removal element,
whereby dirt is retained by the partial buckets to the termination of the backing plate and dumped at that termination onto the dirt removal element.

14. The invention as defined in claim 13 wherein said dirt removal element includes:
a pair of belt rollers journalled to said frame,
a dirt removal belt trained over the rollers, and
belt drive means for rotating said rollers in either direction so that the dirt may be dumped to either side.

15. An excavating machine comprising:
a triangular chain frame,
a power shaft journalled at one corner of the triangular frame,
a bottom shaft journalled at another corner of the triangular frame, and
a back shaft journalled at yet another corner of the triangular frame,
each of said shafts having sprocket means thereon,
chain means trained around said shafts whereby said chain means has
a digging run from the bottom shaft to the power shaft
a removal run from the power shaft to the back shaft, and
a down run from the back shaft to the bottom shaft,
a series of partial buckets attached to said chain means, each bucket having
digging teeth on the bucket spaced away from the chain means,
a front-bottom member extending from said digging teeth to behind the chain means,
trough plates extending from the front-bottom member behind the chain means,
a backing plate attached to the chain frame behind the chain means,
said trough plates moving adjacent to and in close proximity to the backing plate thereby forming a dirt container defined by the backing plate on the chain frame and the front-bottom member and trough plates carried by the chain means,
said backing plate extending along the digging run and
said backing plate extending along a portion of said removal run,
said backing plate terminating on said removal run above a dirt removal element,
whereby dirt is retained by the partial buckets to the termination of the backing plate and dumped at that termination onto the dirt removal element.

* * * * *